US007780004B2

(12) United States Patent
Carlozzi et al.

(10) Patent No.: US 7,780,004 B2
(45) Date of Patent: Aug. 24, 2010

(54) PACKAGE FOR STICK ELECTRODES

(75) Inventors: Emiddio G. Carlozzi, Concord, OH (US); Gregory A. Gerth, Kirtland, OH (US); Herbert H. Matthews, III, Willoughby Hills, OH (US)

(73) Assignee: Lincoln Global, Inc., Monterey Park, CA (US)

( * ) Notice: Subject to any disclaimer, the term of this patent is extended or adjusted under 35 U.S.C. 154(b) by 969 days.

(21) Appl. No.: 11/219,393

(22) Filed: Sep. 6, 2005

(65) Prior Publication Data

US 2007/0051650 A1 Mar. 8, 2007

(51) Int. Cl.
*B65D 85/26* (2006.01)
*B65D 85/20* (2006.01)

(52) U.S. Cl. ..... 206/443; 206/497; 206/776; 383/200

(58) Field of Classification Search ..... 206/443, 206/497, 776, 410, 484, 380, 526; 229/87.01, 229/87.05, 87.02, 117.35; 383/200, 203, 383/207, 209, 64
See application file for complete search history.

(56) References Cited

U.S. PATENT DOCUMENTS 1,682,179 A * 8/1928 Krembs ..... 206/443
3,033,357 A * 5/1962 Vogel ..... 206/574
3,037,620 A * 6/1962 Douty ..... 206/342
4,041,851 A * 8/1977 Jentsch ..... 493/200
4,139,643 A * 2/1979 Hix et al. ..... 426/122
4,428,485 A * 1/1984 Egli ..... 383/203
4,497,407 A * 2/1985 Stager ..... 206/443
4,676,394 A * 6/1987 Hiersteiner ..... 229/117.34
4,705,174 A * 11/1987 Goglio ..... 383/210
5,078,509 A * 1/1992 Center et al. ..... 383/88
5,326,575 A * 7/1994 Spaulding ..... 426/87
5,744,247 A * 4/1998 Anderson ..... 428/475.5
5,885,673 A * 3/1999 Light et al. ..... 428/35.4
6,024,219 A * 2/2000 Froehlich et al. ..... 206/459.5
6,024,220 A * 2/2000 Smith et al. ..... 206/484
6,273,607 B1 * 8/2001 Buchman ..... 383/5
6,352,364 B1 * 3/2002 Mobs ..... 383/200

* cited by examiner

*Primary Examiner*—Mickey Yu
*Assistant Examiner*—Steven A. Reynolds
(74) *Attorney, Agent, or Firm*—Hahn Loeser + Parks LLP

(57) ABSTRACT

A package for a compacted stack of stick electrodes comprising a thin metal foil encapsulating the stack with at least one axial seam and two end closures. One end closure includes a generally flat end portion extending from the stack and terminating in a sealed section of the metal foil spaced outwardly from the stack. The flat end portion including a structure to open the package for access to the stack of electrodes. This package is used in combination with an elongated shipping carton with a vision opening exposing a package therein.

54 Claims, 16 Drawing Sheets

PACKAGE FOR STICK ELECTRODES

The present invention relates to a field of electric arc welding and more particularly to a package for shipping and marketing stick electrodes.

BACKGROUND OF INVENTION

A common procedure in electric arc welding involves the use of stick electrodes which are elongated, rigid consumables having a center wire of alloy steel, an outer flux coating and an exposed shaft at one end. An electrode holder with a clamping device grips the exposed shaft at one end of the electrode for directing welding current through the electrode to melt the end of the electrode and form a weld bead on a workpiece. Stick electrodes are sold by the tens of millions throughout the world and are used by welders in the field. The electrode is connected to the electrode holder and then the welding process is performed. Since the electrode is normally about 14-18 inches long, each electrode is consumed quite rapidly. Consequently, an operator must continuously draw a stick electrode and connect it to the holder. This procedure is done in rapid succession. For that reason, a large number of electrodes are sold in a container or package for sequential removal and use by the operator. A vast majority of stick electrodes are shipped and sold in elongated metal cans that are rigid and include an upper lid opened in the field. When the lid is opened, the electrodes are removed in succession for the welding process. This is a time consuming exercise requiring manual dexterity and causing some difficulty in disposing of the metal cans. Furthermore, when the cans are opened, the electrodes are exposed to atmosphere containing moisture. This moisture can be absorbed by the outer flux coating on the electrodes and, thus, increase the steps needed to provide a sound weld bead. Furthermore, the metal can is rigid and retains its shape and presents the same volume irrespective of the number of electrodes remaining in the container. The removal of individual electrodes in the field presents certain problems so the electrodes are often removed in a group and place in another structure more easily handled by the operator. In summary, packages for stick electrodes have heretofore required removal of electrodes in groups for subsequent use. It was not practical to remove a single electrode from the container for welding with the single electrode. Thus, there is a need for a package to improve shipping and saleability of stick electrodes and facilitate use of individual stick electrodes in the field.

Another problem with containers used in shipping and selling stick electrodes is that the electrode can is a high cost component in the total cost of the electrodes. Normally a single manufacturers design and produces individual cans for specific electrodes. Due to the cost factor, it is difficult for more than one supplier to develop the same can for an electrode manufacturer. The manufacturer of electrodes is not normally constituted to produce the high tech, high cost metal can used for shipping and selling stick electrodes. This purchased item increases the cost of the stick electrodes as well as causing the difficulties during use by the operator in the field. All of these disadvantages and others of stick electrode packaging are overcome by the present invention.

After recognizing the deficiencies of prior packages used in shipping and selling stick electrodes, a novel package was developed using certain performance criteria. The package was to be standardized, decrease movement of the electrodes during shipment, and reduce moisture pick-up. The package was to prevent damage to the electrodes during shipment and had to be capable of stacking pallets of packages for shipment without a tendency to crush or break the coating, especially on electrodes in the lower packages in a large pallet load. Furthermore, to facilitate saleability or merchantability, the package had to have the capability of displaying diverse information and had to be capable of use by the operator, as opposed to removing electrodes from the package before use by the operator. The package must provide the capability of removing a single electrode and, preferably, the whole package should be capable of transporting by an electrode carrier. The package must be easily opened and resealed to prevent moisture accumulation in the outer coating of the electrodes. This avoids the need to heat the electrodes before they are used to drive unwanted moisture from the coating. Employing these factors and many others, the novel package of the present invention was developed.

The Inventive Package

This new package has improved efficiency and is easily used by the customer.

Furthermore, it is easily shipped and can be displayed for sale by the retail outlet or inventory purposes. Thus, the package has improved merchantability and is usable throughout the world so that there is no need for developing individual packages for various worldwide markets. The novel package also replaces the need for metal cans with all the difficulties associated with the purchase, loading, sealing, shipping and end use of this common electrode package. The present invention is a package that satisfies these objectives and criteria in a manner to produce a package that is inexpensive, universal, easily shipped and sold, and easily used in the field.

In accordance with the present invention there is provided a package for a compact stack of stick electrodes. Each electrode has a center wire with an exposed shaft on one end for connection to an electrode holder in a welding operation. The stack of electrodes has a given length and is generally rectangular in cross-section with a cross-sectional width of over four electrodes between a first side and second side of the stack. Preferably, there are at least 5-8 electrodes defining the width of the stack. The cross-sectional height of the stack is at least two electrodes between the spaced parallel sides of the stack. In practice, the height is greater than two electrodes and normally less than six electrodes. The novel package comprises a thin, deformable metal foil encapsulating the stack with at least one axial seam and two end closures. One of the end closures includes a generally flat end portion extending from the stack and terminating in a sealed section of the metal foil. The sealed section is spaced outwardly from the end of the stack. This sealed section is spaced from the top ends of the electrodes having the exposed shaft portion or contact tip. The flat end portion of the package includes a structure to open the vacuum sealed package for access to the internal electrodes. In accordance with an aspect of the invention, the deformable metal foil defines an airtight cavity that matches the electrodes in the stack. The cavity is vacuum sealed to draw and deform the encapsulating foil into contact with the electrodes whereby the foil is deformed by the electrodes and holds the electrodes in a fixed configuration for shipment and sale.

The opening structure of the package is either a tear line or a tear strip, so the end user merely tears off the end of the package. This action exposes the ends of the electrodes for removal individually by the welder. After the vacuum has been released by the tear strip or tear line, the metal foil can be rolled together on the top of the stack for resealing the package. In accordance with a modification of the invention, the opening structure of the flat end portion is alternately opened or closed with a movable closing action by a hand crimp or a slidable element, such as used in well known storage packages. Thus, the seal of the metal foil is released to open the package by moving a closing action by movement in one direction across the flat ends of the package. Then, the package is collapsed manually to remove excessive air and closed by movement across the end portion to reseal the package. Thus, the end portion of the package extending from the stack and constituting the top of the package is selectively opened and sealed closed for removing electrodes from the package. An operator may merely open the package and commence the welding operation using one electrode at a time without resealing. If a partially filled package is going to be stored for subsequent use the package is resealed either by wrapping the foil or mechanically closing the opened end. Thus, the package is convenient for use in the field. Of course, a group of electrodes can be removed from the package if this is the desired procedure in a particular welding process.

The thin aluminum metal foil has at least one axial seam for encapsulating the foil around the stack. In one embodiment, the seam is provided by an adhesive between two layers of the metal foil, which metal foil can be provided with an outer sheet that will accept printed information. In accordance with another aspect of the invention, the seam of the metal foil is provided by a heat sealed layer on one side of the metal foil. The seam includes a junction between the layer on two portions of the foil, which junction is heat sealed. Consequently, either a chemical seal or a heat seal of the aluminum foil is used. This is in accordance with standard aluminum foil packaging technology. A chemically sealed aluminum foil usable by the present invention is the Reyshield A262 EAA film by Alcoa. This film has an adhesive layer which is approximately 60 microns and an aluminum film thickness of about 150 microns. Other chemical or adhesive aluminum foils or metal foils could be used to seal the foil package. The foil has a nominal thickness in the general range of 100-200 microns. A representative laminated foil for heat sealing is a product like Cadpak. This sheet is aluminum foil with polyethylene layers for printing, an oriented polypropylene or nylon for heat sealing. This type of aluminum foil sheet is well known in the packaging field. Thus, either a chemical seal aluminum foil or a laminated heat seal aluminum foil is used in practicing the present invention.

In accordance with another aspect of the invention, the aluminum foil package surrounding a stack of stick electrodes has two outwardly projecting wings formed by two layers of aluminum foil. If the aluminum foil is a single sheet, only one of the extending wings defines the axial seam of the package. When two sheets of aluminum foil are employed, each of the wings constitutes a seam for the foil package. The outwardly protruding wings are instrumental in centering the package in a shipping box or carton. The box or carton has a width greater than the width of the stack, but less than the total width of the stack and the outwardly projecting wings. Consequently, the wings are deformed against the side of the carton or box to center and prevent movement of the aluminum foil package in the shipping carton or box.

When the metal foil is a single sheet, the seam can extend along one side of the stack or both sides of the stack. The seam can also be along the front and/or back faces of the package. The seam, in one aspect of the invention, is an overlapping seam lying flat along one side of the stack. This type seam does not result in a centering wing. In accordance with another aspect of the invention, a corrugated liner is wrapped around the stack between the foil and the stack. This provides a cushion to protect the electrodes as they are held in the vacuum sealed package. Furthermore, as an option, one or more support bands is wrapped around the stack to stabilize the stack in the desired cross-sectional shape preparatory to the stack being encapsulated by the aluminum foil and vacuum sealed. To protect the package from the exposed metal shaft ends or tips of the electrodes, another option is a rigid protective end cap over the end of the electrode stack.

In accordance with the preferred embodiment of the present invention, the stack of stick electrodes is encapsulated by an aluminum or metal foil and vacuum sealed for shipment and storage. Another aspect of the invention is combining this novel package with a shipping box or carton that has an internal cavity generally matching the shape of the novel package. The shipping carton is capable of being opened from one end for removing the foil package in an axial direction. The shipping carton has a flat side coterminous with the face of the metal foil package sp a vision opening of the carton exposes the flat face of the package. Consequently, when the carton with the novel package is displayed, the package is visible to inform the consumer of the type package. The vision opening in the carton is aligned with the flat face of the package, which flat face includes information to be viewed through the carton opening. The lateral wing or two wings of the foil package centers the package in the shipping box or carton.

In accordance with another aspect of the invention, the shipping carton is shaped to receive two or more stacked packages, with the vision opening facing the flat face of the top package in the carton. Thus, one of the packages is exposed, but the carton ships and stores a number of packages constructed in accordance with the present invention. Another option of the invention is using a molded plastic box or carton. The box or carton can contain a single package or several packages with a vision opening to display the package or the top package in the molded plastic container.

In accordance with still a further option of the invention, a transport box is used in combination with shipping boxes containing novel packages. Thus, a transport box carries several of the shipping boxes, each of which shipping box may have one novel foil package or several such packages.

In accordance with another option of the present invention, the thin metal foil has a first section deformed to provide a cavity for the stack of electrodes. A second foil sheet covers the stack in the cavity. These sections or sheets have marginal portions forming a surface-to-surface edge seal around the stack in the cavity. The front end portion is part of the sealed edge of the two sheet package. The marginal edge seal constitutes the seam closing the metal foil package.

In accordance with a further feature of the present invention, the novel package is used with a strap holster so a package can be carried by the belt of an operator. The package itself or the carton housing the package can include belt loops for this purpose.

The primary object of the present invention is the provision of a package for a compacted stack of stick electrodes, which package solves many of the shipping, storing and use problems associated with the prior art stick electrode packages.

Another object of the present invention is the provision of a package, as defined above, which package improves efficiency, reduces costs, increases customer usability, improves merchantability, has worldwide compatible and eliminates the need for metal cans.

Another object of the present invention is the provision of a package, as defined above, which package is combined with a shipping carton or box, which carton accepts one or more of the packages and is easily used in displaying the packages for retail sales and customer inventory storage.

Yet another object of the present invention is the provision of a novel package or packages combined with a shipping carton, which combination is relatively inexpensive, provides easy manufacturing and shipment and facilitates the use of stick electrodes in the field.

These and other objects and advantages will become apparent from the following description taken together with the accompanying drawings.

PREFERRED EMBODIMENTS

Figure 1:
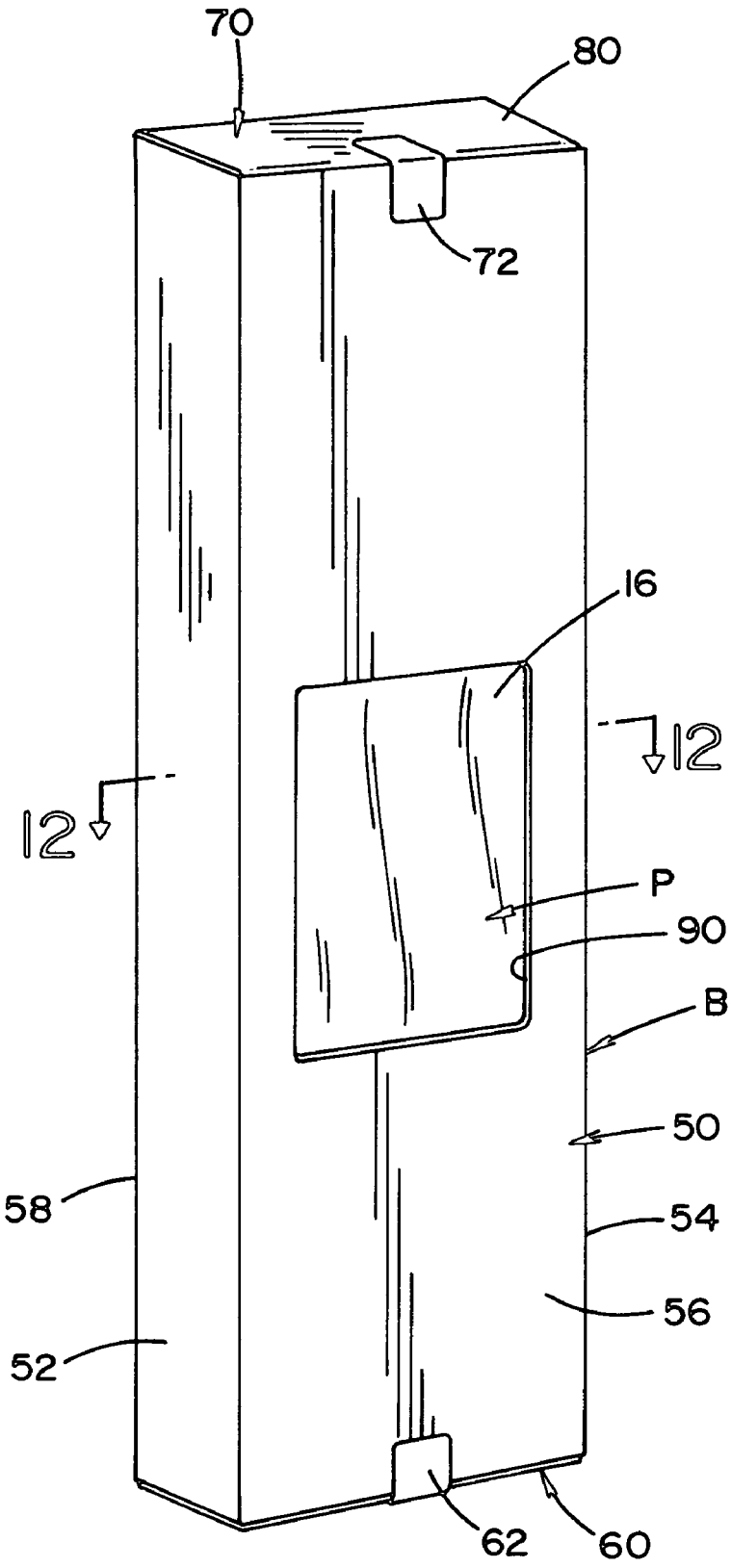
FIG. 1 is a pictorial view of the novel package combined with a shipping carton or box.
Figure 2:
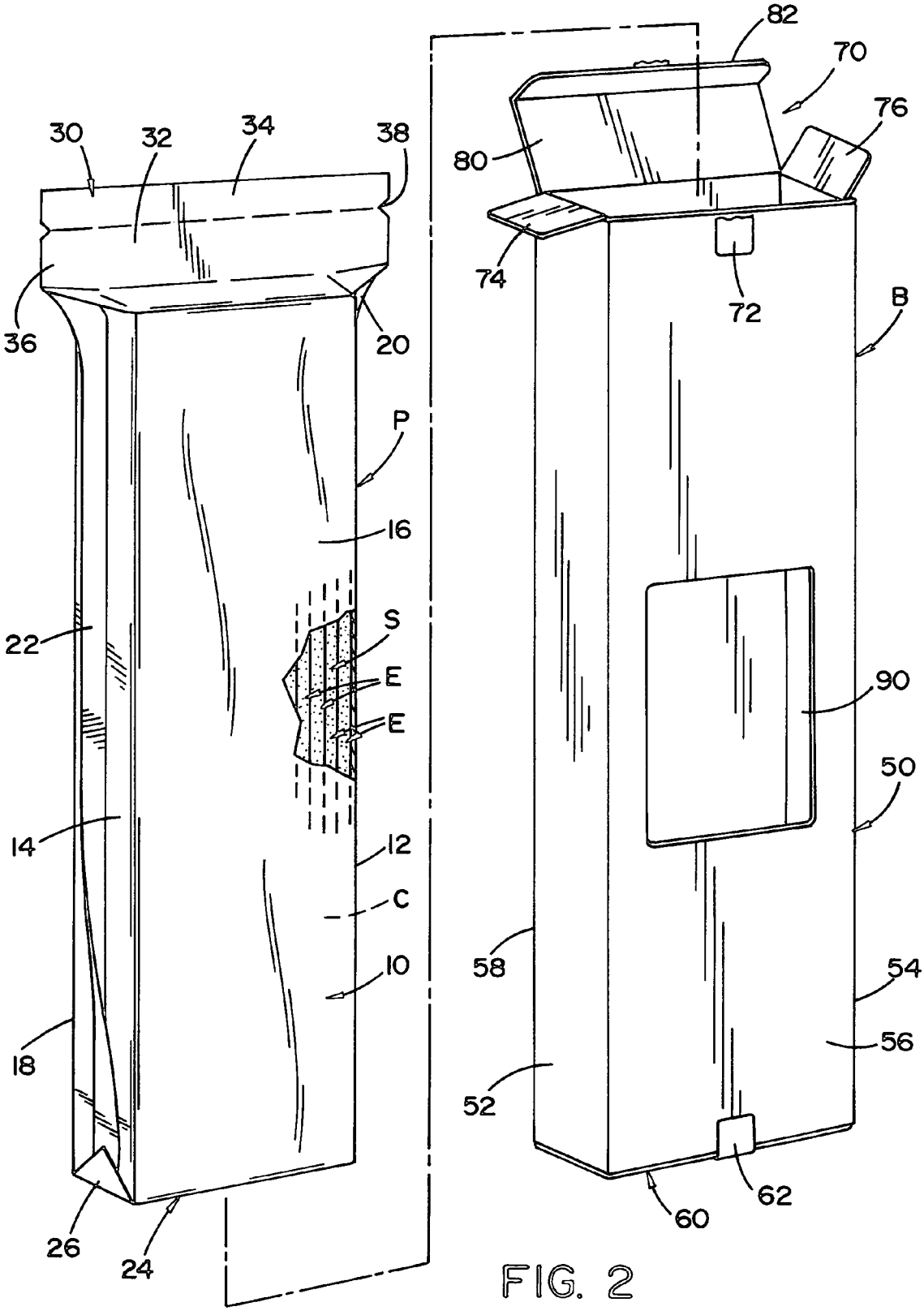
FIG. 2 is a pictorial, exploded view of the package and shipping box or carton constituting the preferred embodiment of the present invention.
Figure 4:
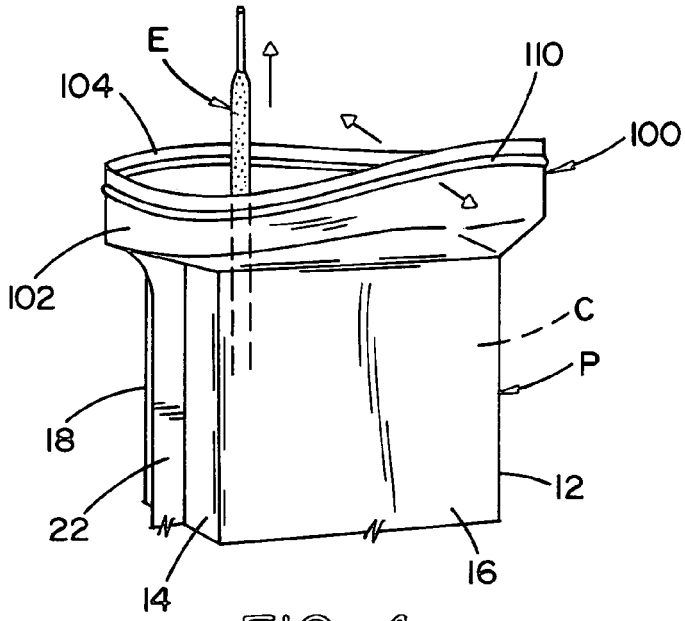
FIG. 4 is a pictorial end view of a manually manipulated end closure structure comprising an embodiment of the invention.
Figure 5:
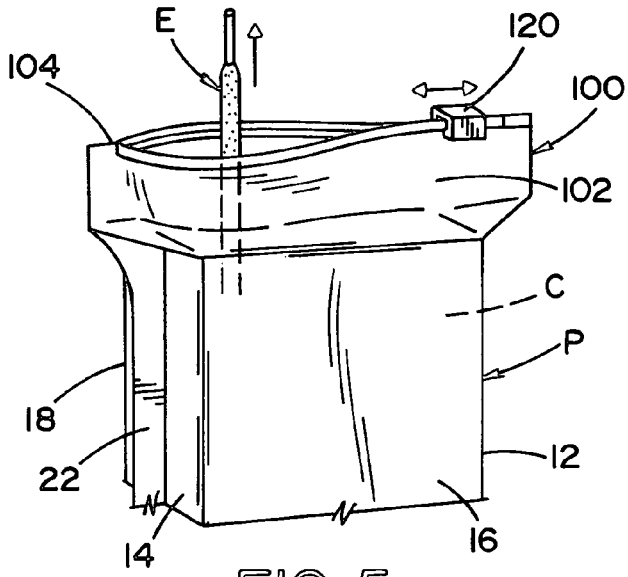
FIG. 5 is a view similar to FIG. 4 illustrating a movable element for opening and closing the end structure of the novel package.

FIGS. 1 and 2 disclose new package P used to encapsulate a stack S of stick electrodes E. The package includes an encapsulating thin metal foil 10 deformed into a rectangular cross-section around rectangular stack S. The foil sheet is drawn by vacuum into engagement with the many electrodes E of stack S to define spaced lateral sides 12, 14 between flat faces 16, 18. In the preferred embodiment, metal foil 10 is a thin aluminum foil joined together at axially extending seams 20, 22 between first end closure 24 with folded flaps 26 and second end closure 30. This second end closure is used to open and close package P by having flat end portion 32 with an outer sealed flat section 34 and an unsealed flat section 36 transitioning into the internal cavity C. Section 36 has a structure 38 for opening the package. Structure 38 is illustrated as a tear line in FIG. 2; however, it could be a tear strip or a common opening and closing system as shown in FIG. 4 and FIG. 5. Unsealed section 36 is communicated with the center cavity C forming the inside cavity of foil 10 after it is wrapped around and collapsed into engagement with the electrodes of stack S. Thus, when end closure 30 is opened at tear strip 38, the package is opened and cavity C is communicated with the atmosphere through unseal section 36. The novelty of the present invention is primarily the structure of package P; however, the invention also involves the combination of package P with a shipping container B shown in FIG. 1 and FIG. 2. In the preferred embodiment, the shipping container is a cardboard box 50 with sides 52, 54 generally parallel to sides 12, 14 of package P. Flat walls 56, 58 are parallel to surfaces 16, 18, respectively. Consequently, container B is a rectangular box for receiving package P with lower end closure 24 resting upon bottom end 60 of box 50 and held closed by tape 62. Thus, the heavy package P is received in box 50 with lower closure 24 engaging the bottom end 60 of the carton or box. Top end 70 of box 50 includes a sealing tape 72 and has transverse side flaps 74, 76 for supporting pivotal lid 80 with a tuck 82. The overall height of package P is generally the same as the overall height of box 50 so that the package usually slips into the top end 70 and is held by the bottom end 60 which also has side flaps, a lid and a tuck. Package P is formed by a thin metal foil deformable into the shape of stack S. The foil is preferably a thin aluminum foil common in the packaging art. Thin means less than about 300 microns. Stack S has a rectangular shape and is encapsulated by metal foil 10 in the form of either a single sheet or two sheets.

Figure 3:
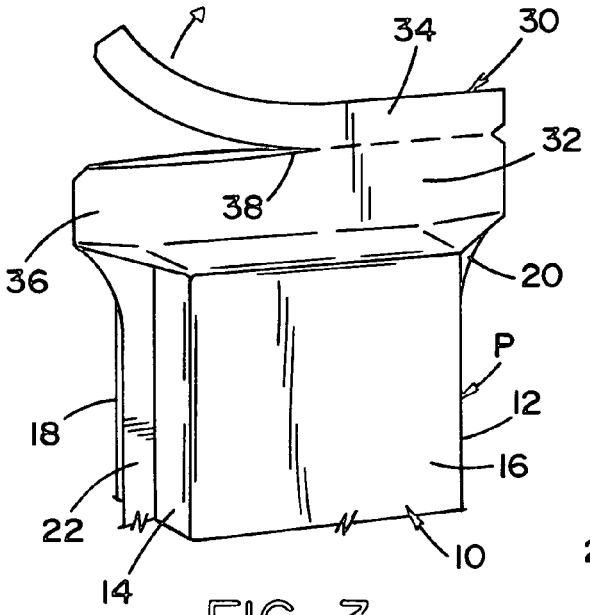
FIGS. 3, 3A, 3B and 3C are partial pictorial views of the top closable end structure used in the preferred embodiment of the present invention for opening the novel package and resealing the package when necessary.
Figure 3A:
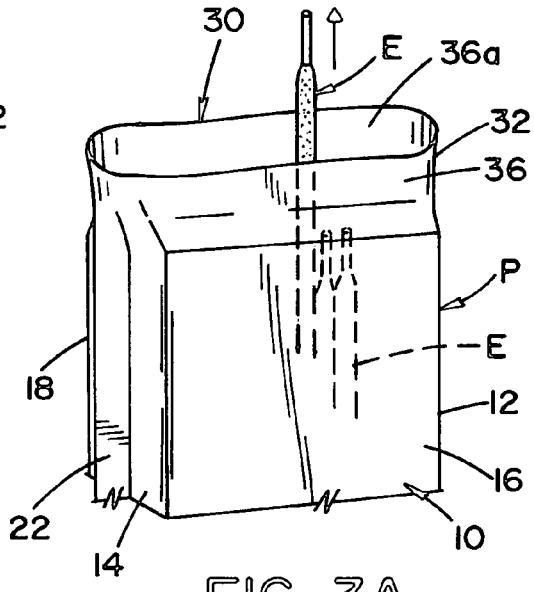
Figure 3B:
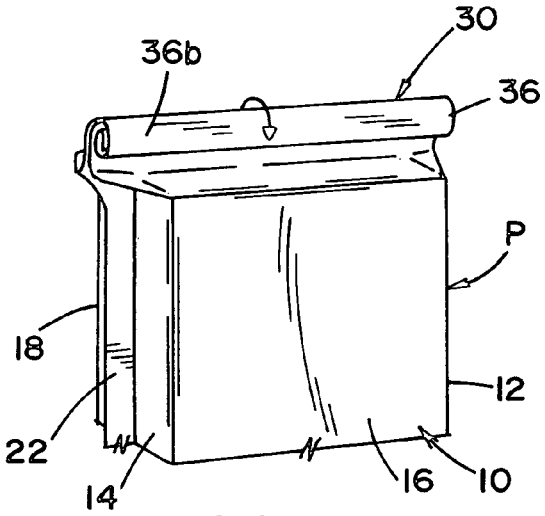
Figure 3C:
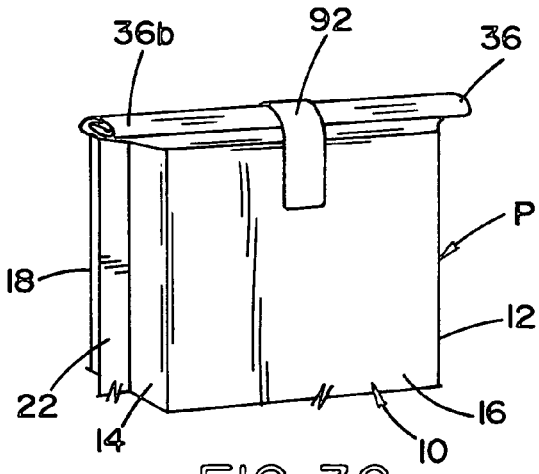

Package P includes an upper closure that can be opened to expose the top ends of the electrodes for removal axially from package P. In accordance with an aspect of the invention, the combination of package P and container B provides a convenient shipping arrangement with appropriate printed material on the outer surface of box 50. To reveal the contents of box 50, a secondary aspect of the invention is the provision of vision opening 90 in wall 56 to expose a portion of flat surface 16 of the electrode package. A package in a shipping box is shipped and sold and can be stored in an inventory area of the end user. The end user opens top end 70 and removes package P. To remove an electrode, tear strip or tear line 38 separates outer sealed section 34 so the electrodes can be manually accessed. In practice, successive, single electrodes are removed and used in the welding process. This procedure is schematically illustrated in FIG. 3 and FIG. 3A. In FIG. 3, section 34 is separated at tear strip or tear line 38 to open package P. As shown in FIG. 3A, unsealed section 36 is opened to define access mouth 36*a* for removal of electrode E. To close and seal package P between welding operations, mouth 36*a* is closed and section 36 is rolled into a tight seam 36*b*, as shown in FIG. 3B. This transverse wrapped seam is airtight and is held together by the mechanical characteristics or memory of metal foil 10. Such metal foil can be molded and held together by mere manual manipulation of the aluminum foil. Seam 36*b* makes package P airtight, but without internal vacuum. Even though rolled seam 36*b* is sufficient to close package P, the package can be further held shut by tape section 92, as shown in FIG. 3C. FIGS. 3, 3A,. 3B and 3C illustrate an advantage of having a package with an external closure section that can be opened for access to the electrodes and closed by manipulation of the aluminum metal foil 10. These illustrations disclose an advantage of the present invention involving a thin metal foil deformed around stack S for shipment and then individual use of the electrodes.

The tear line or tear strip 38, as shown in FIG. 3, is the preferred closure structure; however, FIGS. 4 and 5 illustrate alternative closure systems. In FIG. 4, end structure 100 includes an unsealed section 102 and a sealed section 104. Sealed section 104 is opened and closed by a transverse manipulation of male and female elements across section 104. This structure is closed by snapping the elements of the foil together and by progressively applying pressure across sealed section 104. To open closure 100, the structure 110 formed by matching elements on the foil is merely pulled apart, as shown in FIG. 4. This manual sealing and opening structure is well known in the art of storage packages. In a like manner, another common arrangement is the movable element 120 shown in FIG. 5. The element is moved to the left to force together the male and female sections of the foil and thereby seal package P. Movement of element 120 to the right opens the package as shown in FIG. 5 for removal of electrode E. The structure show in FIGS. 4 and 5 is equivalent to the structure shown in FIGS. 3, 3A, 3B and 3C. The package can be opened and closed by a standard system, well known in the packaging art as shown in FIGS. 4 and 5, but the preferred implementation is shown in FIGS. 3, 3A and 3B.

Figure 6A:
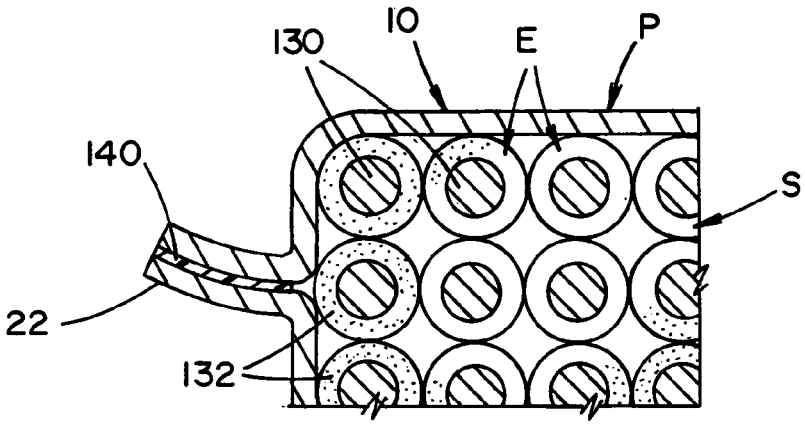
FIG. 6A is an enlarged partial cross-sectional view illustrating an adhesive axial seal to the novel package.
Figure 6B:
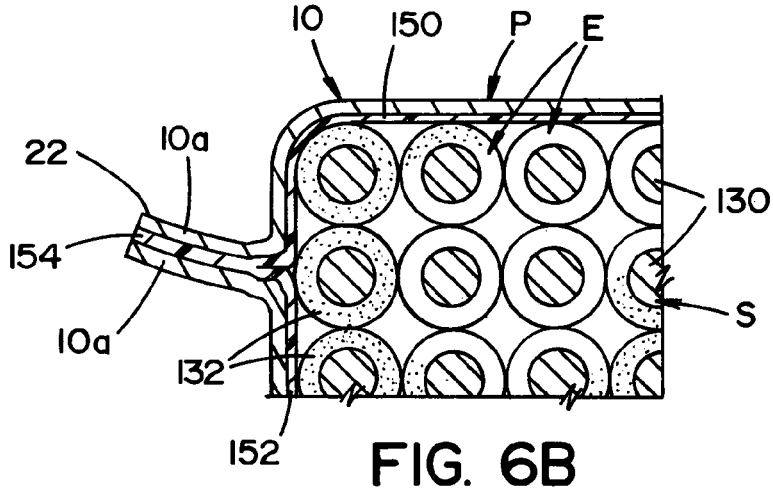
FIG. 6B is a view similar to FIG. 6A showing the use of a heat sealed axial seam.

The package of the present invention is formed from a deformable, thin metal foil such as domestic aluminum foil. Axial seam 22 or axial seams 20 and 22 are formed by surface joining of the aluminum foil sheets. Foil 10 surrounds stack S formed from electrodes E each comprising a center rod 130 and an outer coating 132 as schematically illustrated in FIGS. 6A and 6B. Axial seam 22 is formed from an adhesive or chemical sealing structure 140, as shown in FIG. 6A, or a chemical heat sealing structure as shown in FIG. 6B. Foil 10 of FIG. 6A is a EAA film, such as Reyshield A262 from Alcoa or A282 from Alcoa. An ethylene/acrylic acid film is provided on the inner surface of the foil. This produces an adhesive seal 140 to join the foil at seam 22. Foil 10 in FIG. 6B is a laminated sheet wherein layer 150, 152 are heat sealable at marginal joint 154.

Figure 6C:
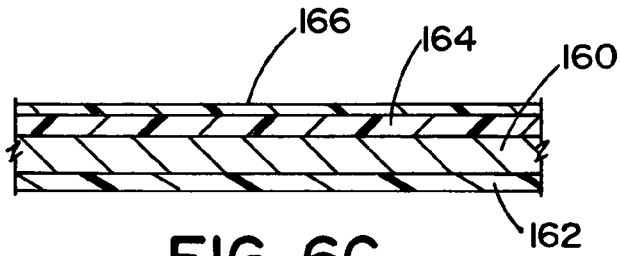
FIG. 6C is an enlarged cross-sectional view illustrating one embodiment of the metal foil sheet used in producing a heat seal seam as schematically illustrated in FIG. 6B.

This type of aluminum foil is schematically illustrated in the cross-section of FIG. 6C. Aluminum foil 160 has a heat seal layer 162 to perform a heat seal and is shown as layers 150, 152 in FIG. 6B. Aluminum foil 10*a* is a laminate structure used for heat sealing as shown in FIG. 6B. Layer 162 on the foil sheet is layers 150, 152 of joint 22, as shown in FIG. 6B. In this particular laminate structure, outer nylon layer 164 increases puncture resistance and outer layer 166 is added to provide the ability to print onto faces 16, 18 of package P. Several types of aluminum foil, either heat seals or chemical adhesive, is used in forming package P. These various concepts are schematically illustrated in FIGS. 6A, 6B and 6C.

Figure 7:
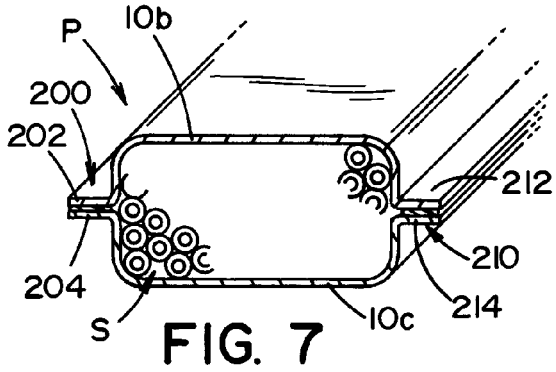
FIG. 7 is a cross-sectional view taken through the package constructed in accordance with the present invention, where the package has two outwardly extending wings formed from two metal foil sheets.
Figure 8:
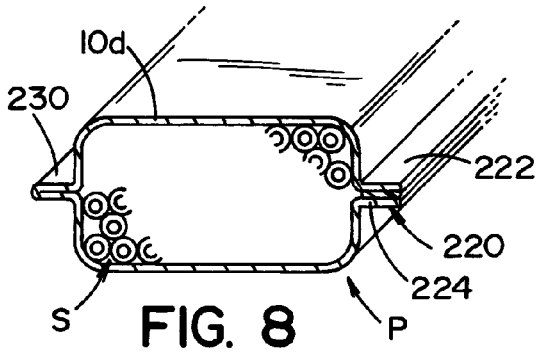
FIG. 8, FIG. 9 and FIG. 10 is a view similar to FIG. 7 showing the novel package of the present invention using a single metal foil sheet with different axial seam arrangements.
Figure 9:
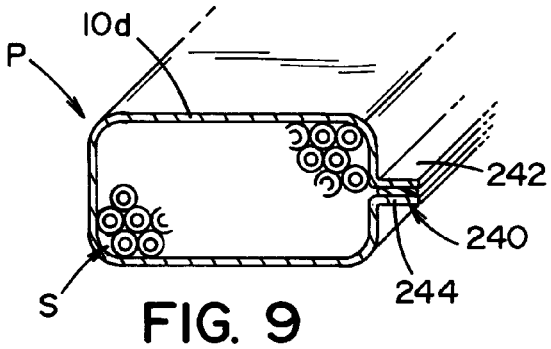
Figure 10:
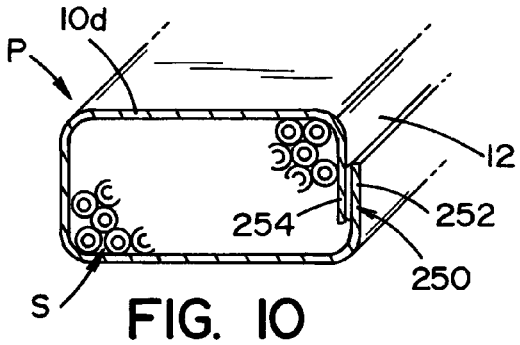
Figure 11:
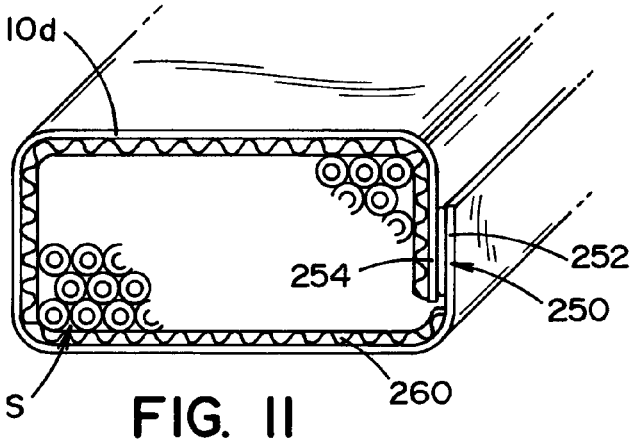
FIG. 11 is a view generally similar to FIGS. 7-10 showing the use of a corrugated liner between the electrodes and encapsulating metal foil sheet comprising the present invention.

The axial seam and number of foil sheets of package P can vary, as shown in FIGS. 7-10. In FIG. 7, package P is formed from two aluminum foil sheets 10*b*, 10*c*. These two sheets form outwardly protruding seam 200 which corresponds to seam 22 in FIG. 1. Seam 200 is formed by sheet flanges 202, 204. In a like manner, the two aluminum foils form opposite protruding seam 210 comprising flanges 212, 214. This seam corresponds to seam 20 of FIG. 1. As will be explained later, seams 200, 210 form outwardly extending wings for centering package P in container B. Such wings can also be formed when using a single sheet 10*d* as shown in FIG. 8. In this arrangement, protruding seam 220 is formed by sheet flanges 222, 224. The wing on the opposite side of package P is merely a folded area 230. In this manner, the same cross-sectional shape is created in a package using two aluminum foil sheets, as in FIG. 7, or a single aluminum foil sheet as shown in FIG. 8. Single sheet 10*d* can form a single outward seam 240 formed by sheet flanges 242, 244, as shown in FIG. 9. A single sheet version of package P can form an overlapping seam 250 where layers 252, 254 merely overlap, are adhered together and lay flat against side 12. Heat sealing of this seam is difficult because anvils are necessary on both sides of a heat sealed seam as shown in FIG. 6B. Any of the versions of the invention shown in FIGS. 7-10 can include an internal corrugated liner 260, as shown in FIG. 11. In this modification, the seam arrangement shown in FIG. 10 is modified to incorporate protective corrugated liner 260. This same liner can be used in other embodiments of the invention. Liner 260 protects the aluminum foil from damage as the foil is forced against the outer surface of stack S during the vacuum sealing operation and shipment.

Figure 13:
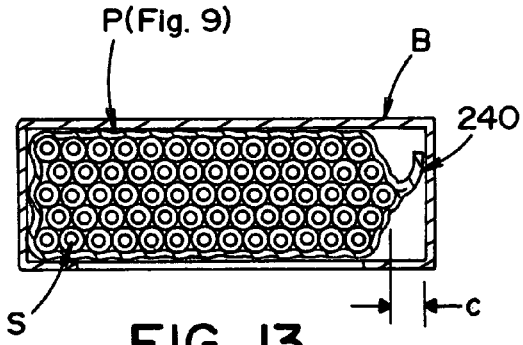
FIG. 13 is a cross-sectional view similar to FIG. 12 showing a modification of the preferred embodiment of the present invention.
Figure 12:
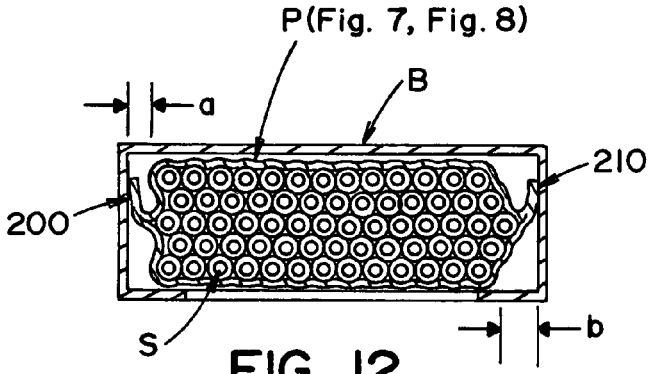
FIG. 12 is a cross-sectional view generally along line 12-12 of FIG. 1.

FIG. 12 illustrates the concept of centering package P within container B by using outwardly protruding seams 200, 210 forming wings. These wings or seams have combined transverse dimension greatly exceeding the size differential between container B and stack S. In other words, the total spacing a+b is substantially less than the total width of the wings or seams 200, 210. If a single seam or wing is employed, as shown in FIG. 13, the difference in spacing between stack S and the dimension of container B is c. This dimension is substantially less than the width of single outwardly protruding wing or seam 240. Thus, the seams or outwardly extending wings allow substantial tolerance in the width of package P as it is manufactured by being vacuum formed around the compact stack S. The outboard wings compensate for any created spacing.

Figure 14:
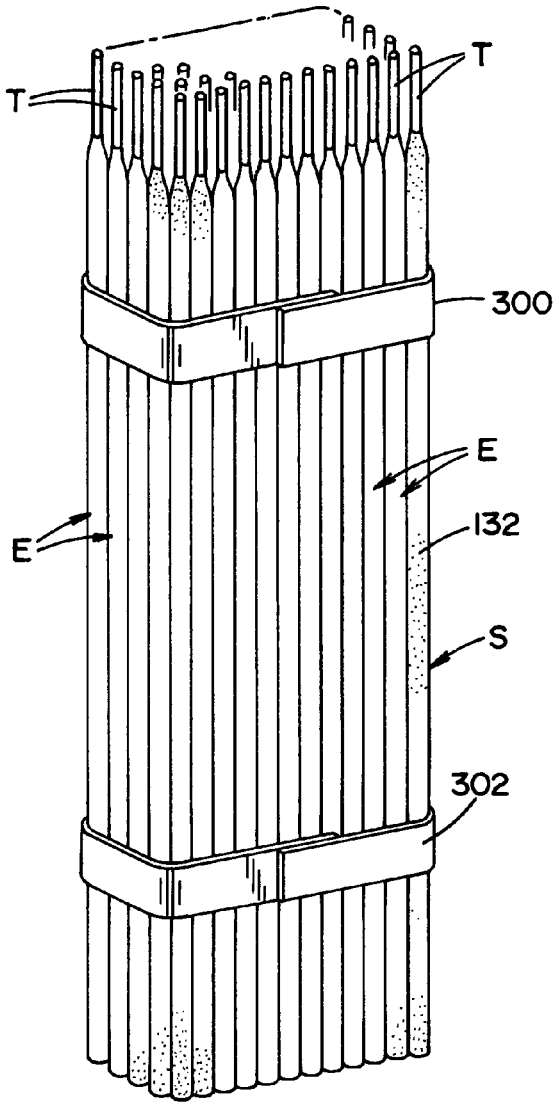
FIG. 14 is a pictorial view showing bands around the stick electrode stack before the stack is encapsulated by a metal foil to make the package of the present invention.
Figure 15A:
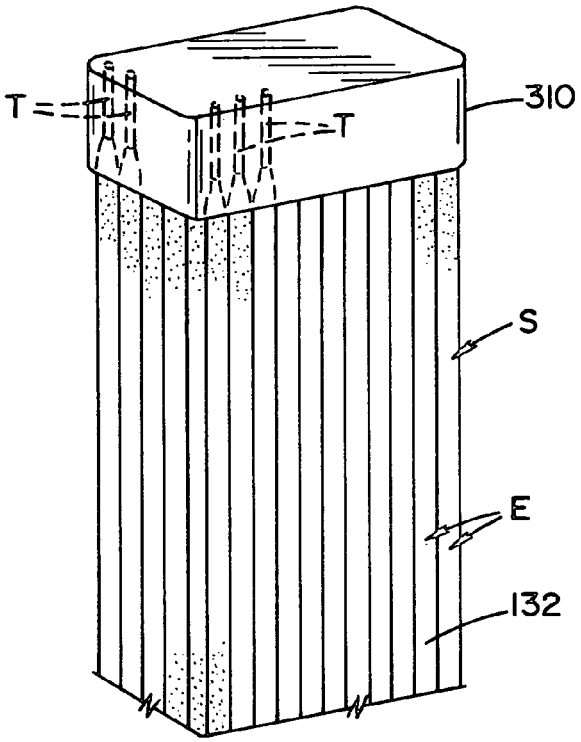
FIG. 15A is a pictorial view showing an end cap over the exposed tips of the stick electrodes forming the stack packaged in accordance with the invention.
Figure 15B:
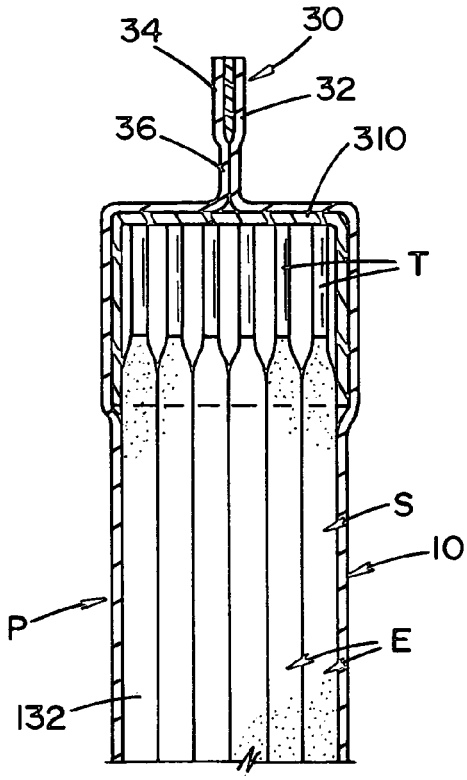
FIG. 15B is a side cross-sectional view of the cap and electrode stack shown in FIG. 15A encapsulated with a metal foil in accordance with the present invention.

To retain the shape of stack S one embodiment involves encircling bands 300, 302 as shown in FIG. 14. The exposed shaft or tip T at one end of electrode E is illustrated. The stack includes a large number of electrodes with all the electrodes having a shaft or tip T extending upwardly. The shaft or tip is used to connect the electrode with an electrode holder for the purposes of electric arc welding. Bands 300, 302 are optional and are not used in all embodiments. They do tend to maintain the shape of the electrode stack. To protect foil 10 from penetration by upwardly extending shaft or tip T, an end cap 310 can be placed over the end of electrodes E at the top end of stack S. This cap is plastic and is illustrated in FIG. 15A. Thereafter, the package is formed in accordance with FIGS. 1 and 2 resulting in end cap 310 forming a mechanical barrier between tips T and aluminum foil 10 of package P. This is shown in FIG. 15B. The structures in FIGS. 14, 15A and 15B are optional concepts and do not form a primary aspect of the present invention.

Figure 16:
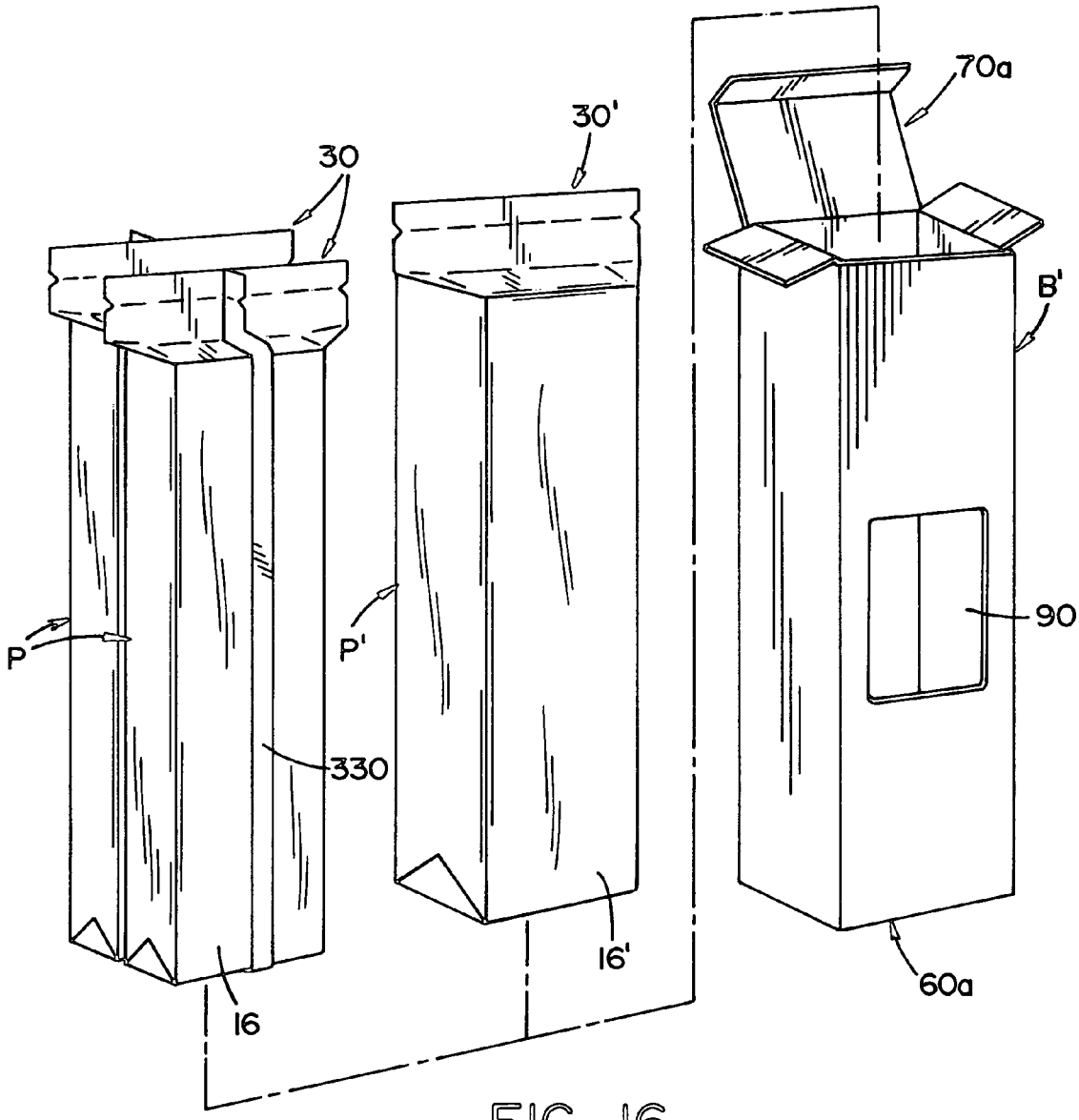
FIG. 16 is a two part exploded pictorial view of a package constructed in accordance with the present invention wherein a single large package or two smaller packages are combined with a shipping box sized to accept a larger number of electrodes than the shipping box shown in FIG. 1.

FIG. 16 shows further use of the present invention wherein two packages P are placed side-by-side and inserted into a larger container B' having a lower end 60a and an upper closing end 70*a*. Each of the packages has an exposed surface 16 that can be seen through vision opening 90 in container B'. The container is a cardboard box having a shape determined by the number of packages to be placed in a single box. In practice, this number is greater than two packages, even though two packages are illustrated in FIG. 16. As an adjunct to the concept of an enlarged container B', the package can be doubled in size with two stacks of electrodes inside package P'. Package P' has face 16', which face is exposed through opening 90. The structure shown in FIG. 16 merely teaches that two or more packages P can be loaded into a single cardboard shipping box. As an alternative, a larger package P' having more than one stack of electrodes can be encapsulated by a single aluminum metal foil structure. For the purposes of illustration only, package P is shown with an axial seam located in the center of face 16. This illustrates that the axial seam can be on either edge or in the center. Of course, the edge seams are preferred and is used in practicing the present invention.

Figure 17:
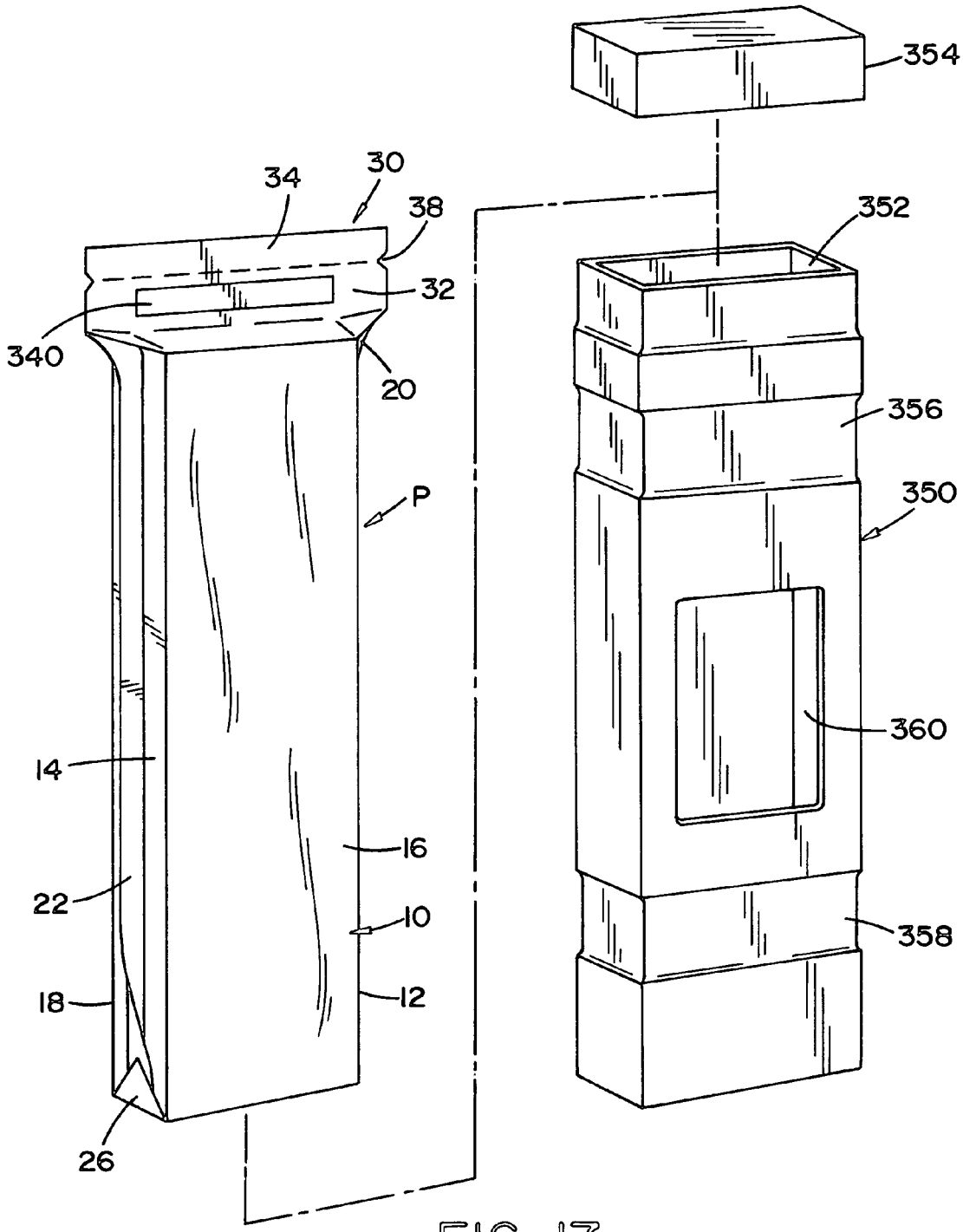
FIG. 17 is an exploded pictorial view illustrating a plastic molded box or carton to be combined with a package constructed in accordance with the present invention for shipping and storing stick electrodes.
Figure 18:
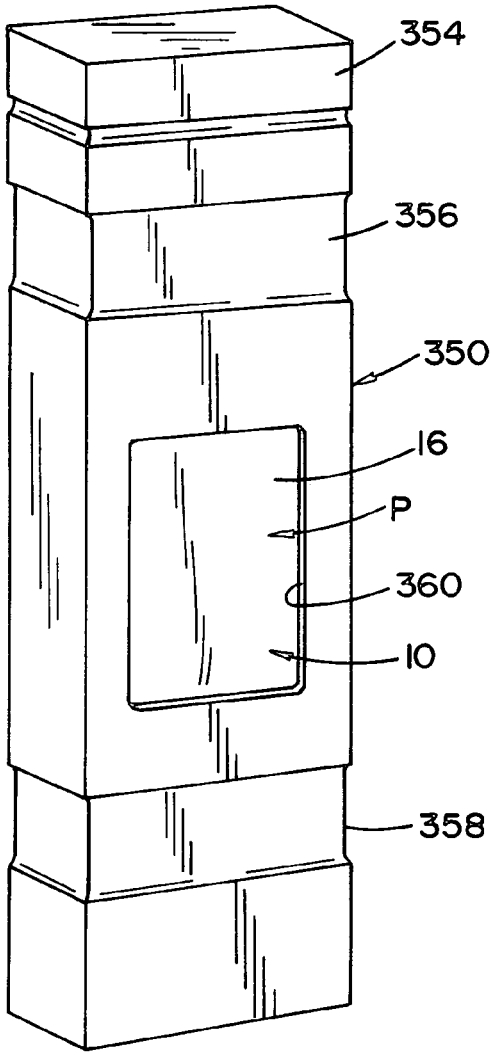
FIG. 18 is a pictorial view showing the elements of FIG. 17 combined ready for shipment.
Figure 19:
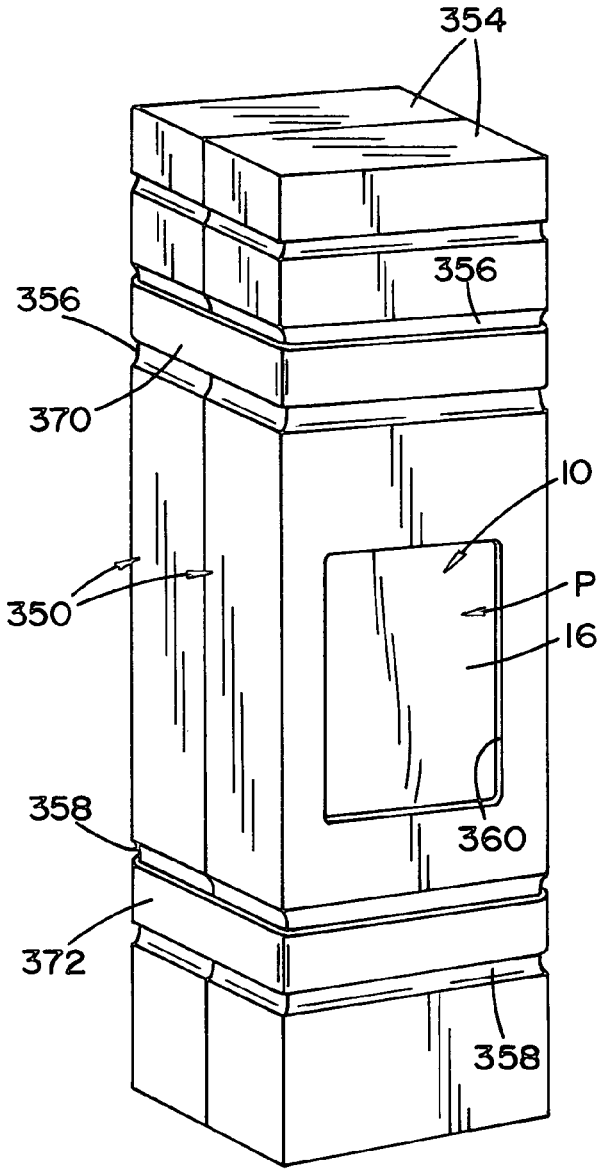
FIG. 19 is a pictorial view showing a plurality of plastic shipping cartons as shown in FIG. 18.

Another modification of the invention is illustrated in FIGS. 17-18 wherein package P is combined with molded shipping carton 350 having an upper opening 352 closed by lid 354. Recesses 356, 358 are spaced from opposite sides of vision opening 360. In FIG. 17, package P has a label 340 which can be color coded to identify the type of electrode in the package or can provide other information specific to the electrodes in package P. As shown in FIG. 18, package P is inserted into molded plastic carton 350 having an internal shape generally the same as the shape of container B in FIGS. 1 and 2. Then lid 354 closes opening 352 and face 16 of package P is exposed through opening 360, as shown in FIG. 18. To ship more electrodes in a single container, two cartons or boxes 350 having rectangular shape generally matching container B are each loaded with an electrode package P. Then the containers are held together by bands 370 372 wrapped around recesses 356, 358 of both containers. In this manner, either a single box 350 can be shipped, displayed and sold or a series of boxes can be mounted together, as taught in FIG. 19. This expansion of the number of containers shows the versatility of using package P for a group of stick electrodes.

Figure 20:
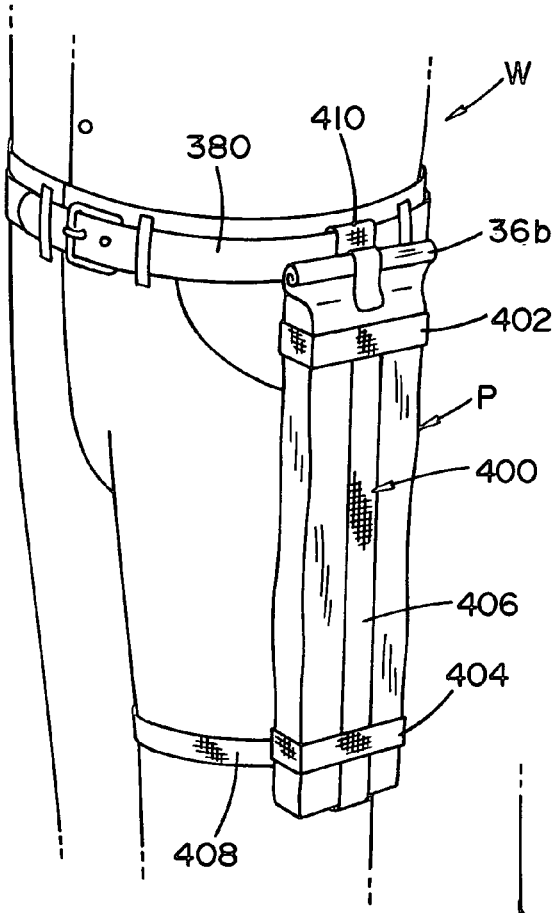
FIGS. 20 and 21 show a strap holster used by an operator for carrying either a package constructed in accordance with the present invention or a shipping box containing a package constructed in accordance with the present invention.
Figure 21:
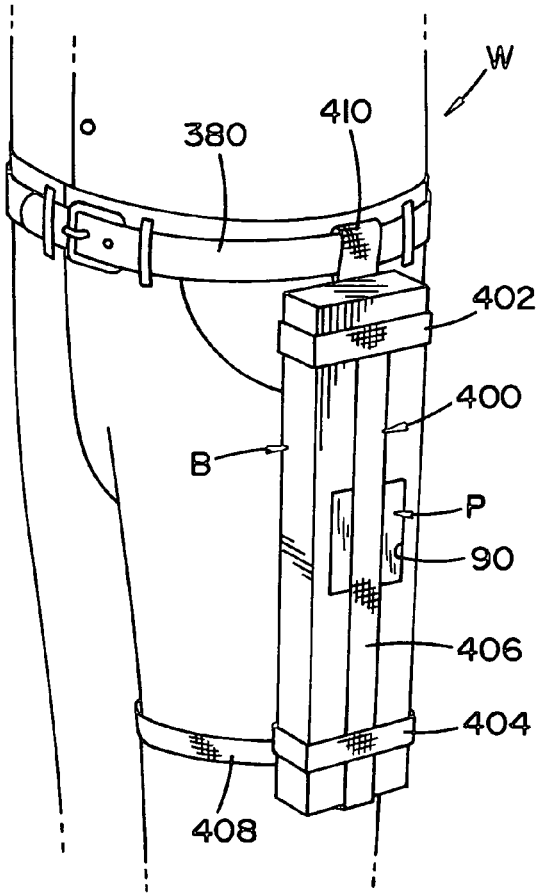

After a consumer purchases package P in container B, the package can be removed from the box and used by removing individual electrodes from package P. As an alternative, the container itself may be opened and used for supporting the electrodes in package P after the package has been opened. In either instance, the package or the container with a package is well suited for transporting in a waist mounted holster, as shown in FIGS. 20 and 21. Holster 400 includes two vertically spaced surrounding straps 402, 404 with a front and back vertical support strip where only the front strip 406 is illustrated. These strips are sewed together with cloth straps 402, 404 having a length to surround either package P or container B. Releasable leg band 408 connects strap 404 around the leg of welder W. At the upper end of strap 402, the inside vertical support strip extends upwardly and terminates in a belt loop 410 to hang the holster or belt 380. By using this carrier or holster, either a package P, as shown in FIG. 20, or container B, as shown in FIG. 21, is carried by the welder for easy access to the individual electrodes within package P. If several packages are shipped in enlarged container B', as explained in FIG. 16, a package is first removed and placed in the holster 400, as shown in FIG. 20. Otherwise, the container itself can be carried by the holster.

Figure 22A:
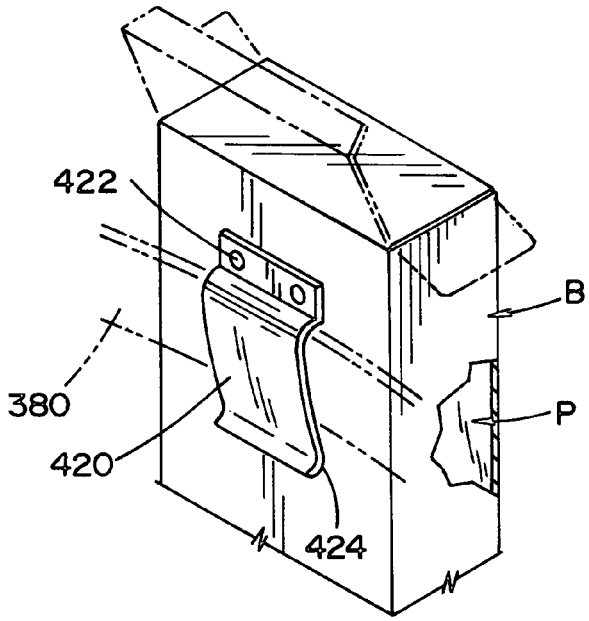
FIGS. 22A, 22B and 22C illustrate shipping boxes or cartons having belt structures for carrying the box containing a novel package of the present invention.
Figure 22B:
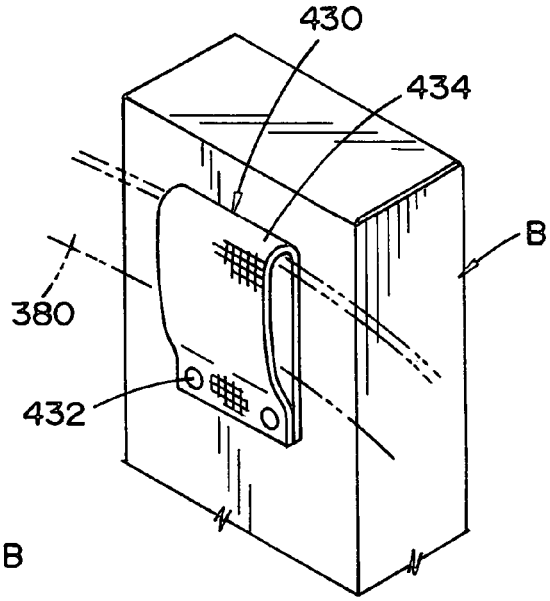
Figure 22C:
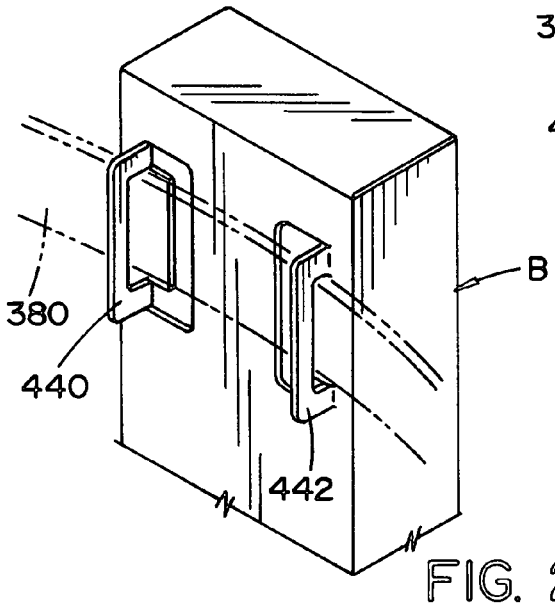

The container can also be mounted on the belt 380 of welder W by structural elements on the container. Examples of this concept are illustrated in FIGS. 22A-22B and 22C. Belt clasp 420 is riveted at area 422 to the back of container B carrying package P. Loose end 424 allows clasp 420 to snap over belt 380 for easy mounting of the electrode container. In a similar manner, fabric structure 430 is riveted to container B at area 432. Fabric structure 430 defines belt loop 434 that surrounds belt 380. Container B can have two C-shaped cardboard tabs 440, 442 lanced from the bottom of the box. These tabs also form openings for belt 380. In this manner, the container itself is mounted onto the belt of the welder or onto other structure for use in the stick welding process.

Figure 23:
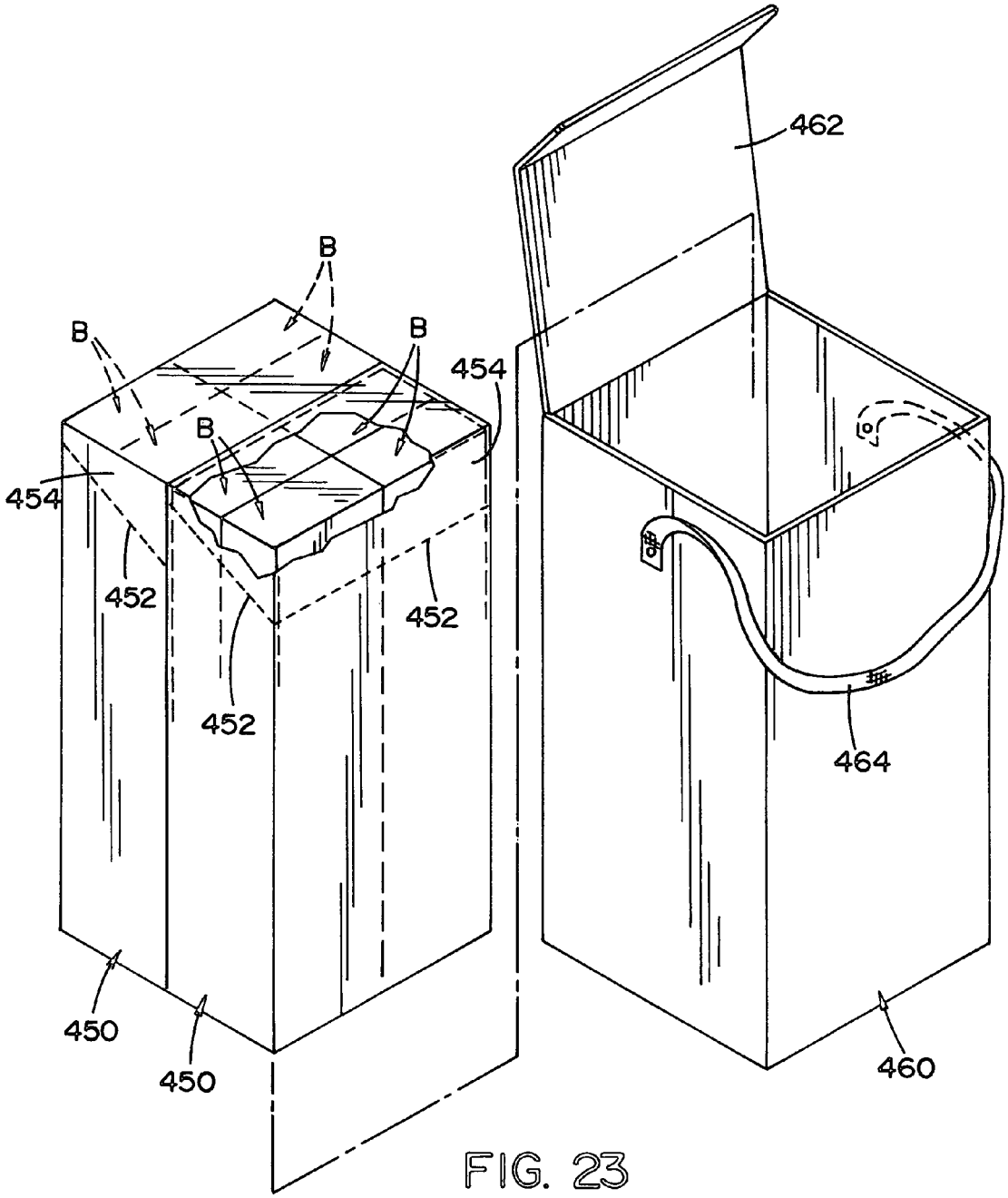
FIG. 23 is an exploded pictorial view of a carrier carton and display cartons to be placed in the carton.

Another advantage obtained by using the present invention is illustrated in FIG. 23 wherein two cartons 450, each receive four separate shipping containers B. Each carton 450 has a perforated seam 452 to define a removable triangular lid 454. Each carton 450 with four shipping containers B can be placed on a display rack with triangular lid 454 removed. Thus, data on the ends of the boxes display the type of stick electrodes in each of the boxes. The top box is removed and then the bottom box is removed in retail sales or used on the welding site. This same display and dispensing structure can be used for six, eight or even ten containers mounted in a single carton 450. This shipping, displaying and dispensing concept is illustrated in FIG. 23. Four separate containers B are displayable and saleable through the end of carton 450. To carry these display cartons to the job site, another feature of the present invention is placing two cartons 450 in master carrier carton 460 having an upper lid 462 and a handle 464. The master carrier carton allows the end user to carry many cartons to the desired inventory location and display them by removing triangular lids 454. This forms a front opening to dispense the bottommost container. FIGS. 20-23 describe adjunct advantages made possible by the use of a metal foil package to wrap the various electrodes.

Package P comprises an aluminum foil vacuum packed around stack S of electrodes E. The electrode stack is rectangular in cross-section and includes over four electrodes between the first side 12 and second side 14 of the stacks. A cross-sectional height of the stack is at least two electrodes between the sides 16, 18. These numbers define minimum dimensions for stack S. As shown in several of the examples, the height of the stack of electrodes may be as great as six electrodes and the width may be as large as about eight to ten electrodes. The size of the stack is given as an example, not as a limitation. The term stack is used to indicate a generally rectangular shape in cross-section, as distinguished from a wide group of side-by-side electrodes. The number of electrodes comprising this shape may vary for the convenience of the manufacturer; however, since the electrodes are fairly heavy the number of electrodes should be limited to less than about fifty electrodes. The size and shape of the stack of electrodes can vary without departing from the intended scope of the present invention.

Figure 24A:
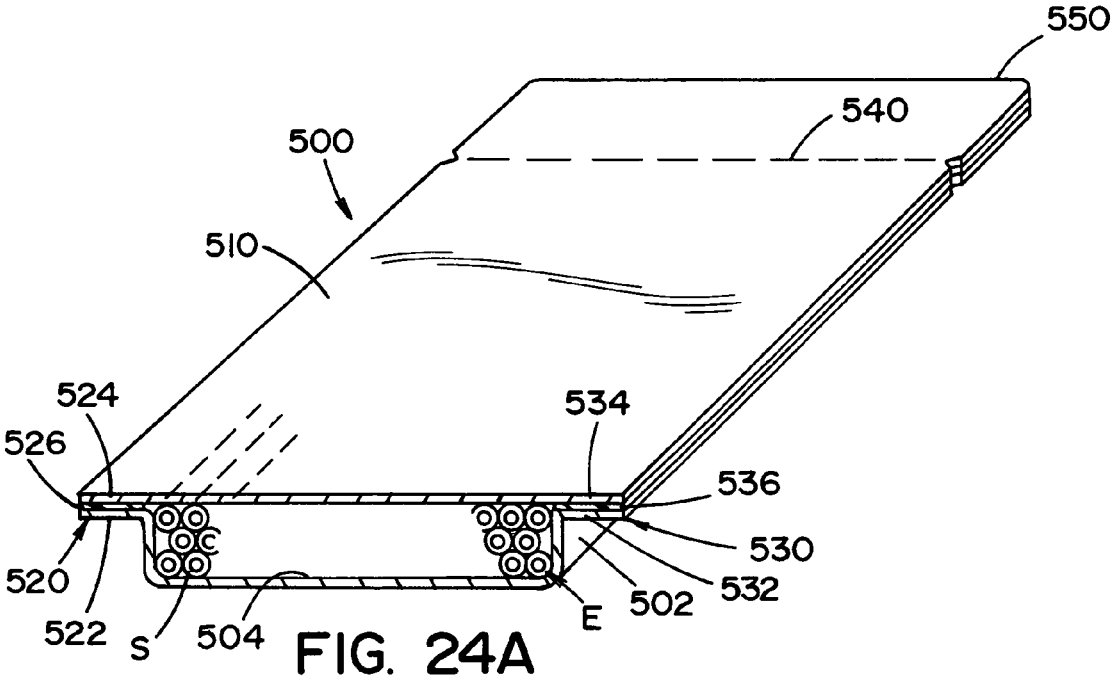
FIG. 24A is a partial pictorial view in cross-section of another embodiment of the present invention, wherein the metal foil is formed into a receptacle or cavity to accept the stick electrodes.
Figure 24B:
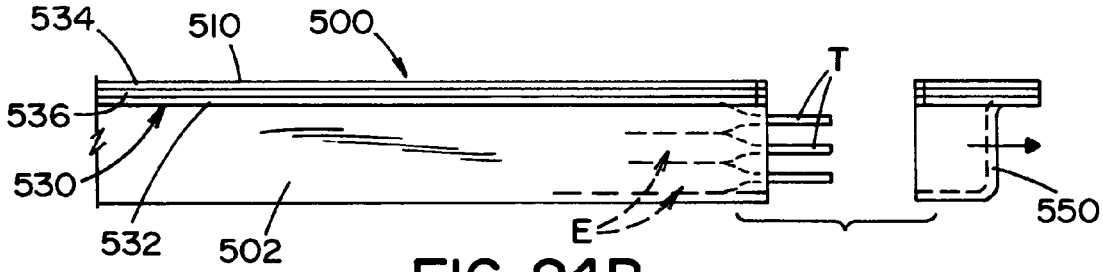
FIG. 24B is a side view of the top portion of the embodiment of the invention shown in FIG. 24A.

In accordance with another aspect of the invention, the package can involve forming of aluminum foil with a cavity to receive the electrode stack. Such package is illustrated in FIGS. 24A, 24B, wherein package 500 includes a lower metal foil 502 with an extruded cavity 504 to receive the stack of electrodes after the cavity has been formed. Cover sheet 510 of aluminum foil is then placed over metal foil 502 to over the electrode stack S. Around the electrodes foil sheets 502 and 510 are sealed to define a marginal edge seal. The sealing action produces a seam 520 between marginal edge 522 and marginal edge 524 which seam is held together by the adhesive 526. On the other side, a seam 530 joins marginal edge 532 and marginal edge 534 held together by adhesive 536. Of course, the marginal edge seam extends around the electrodes and is disclosed only by illustrating the seams at each side of package 500. One end of the package includes perforations 540 so end 550 can be removed from the package to expose electrodes E as shown in FIG. 24B. Package 500 is not resealable; however, a preformed aluminum sheet can be provided to seal package 500 in the same manner as shown in FIGS. 1 and 2.

Figure 26:
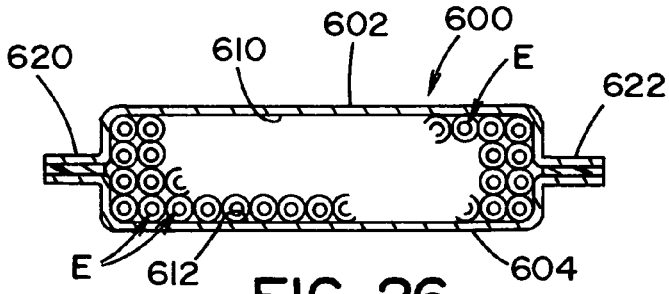
Figure 25:
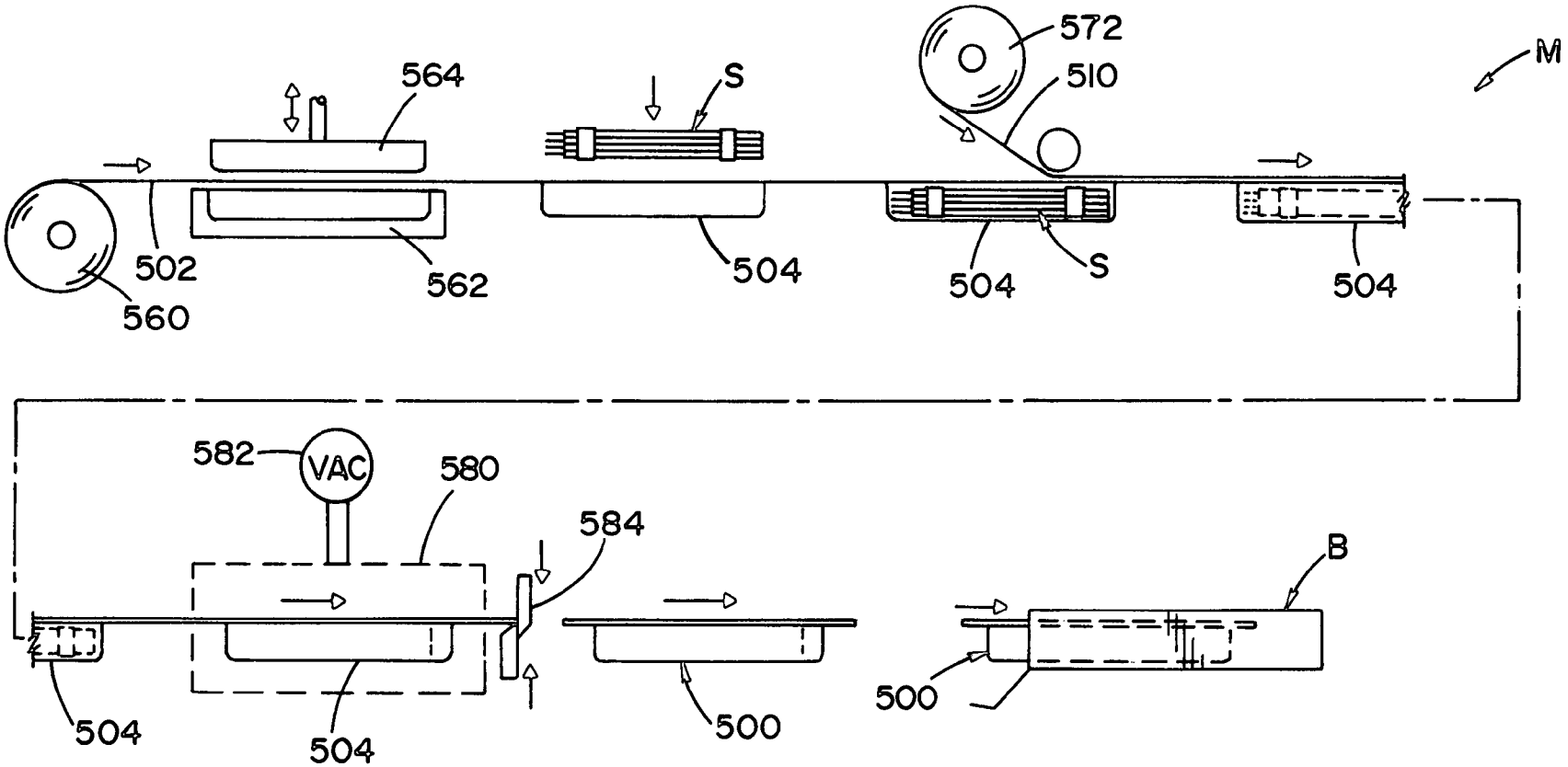
FIG. 25 is a flow chart schematically illustrating the manufacturing procedure for forming the package illustrated in FIGS. 24A and 24B; and, FIG. 26 is a cross-sectional view of a package formed by two opposed cavities in separate foil sheets.

A representative method M for forming package 500 is illustrated in FIG. 25 wherein the bottom aluminum foil sheet 502 is supplied by reel 560. The bottom foil passes into a station including mold 562 and platen 564. The platen extrudes aluminum sheet 502 to provide cavity 504 having a shape to receive stack S. Thereafter, the sheet 502 with stack S in cavity 504 is passed below reel 572 used to supply cover aluminum foil sheet 510 over the top of sheet 502. This closes package 500 before it is moved into a vacuum sealing station 580 where vacuum supply 582 creates a vacuum in cavity 504 and seals the marginal edges around cavity completing package 500. Then cutter 584 severs the package into the desired length with the marginal seal between the cover and lower sheet. Package 500 is then placed in container B for stacking with other boxes and shipping to the retail outlet or other end user. Other methods can be used to form a package around electrodes deposited into a drawn cavity formed in an aluminum foil sheet. In FIG. 26, package 600 is formed by two foil sheets 602, 604 having formed cavities 610, 612 to receive electrodes E. Seams 620, 622 can be constructed as disclosed in FIGS. 6A, 6B.

The invention has been described using certain practical examples; however, other structures can be used to formulate a metal foil package vacuum packed around a fixed stack of electrodes so that the package has one or more of the advantages set forth and described in this application.

Having thus defined the invention, the following is claimed:

1. A package of a compacted stack of stick electrodes, said package comprising a plurality of electrodes each having a center wire with an exposed shaft on one end and together forming a stack of electrodes, said stack having a given length and being generally rectangular in cross-section with a cross-sectional width of over four electrodes between a first and second side of said stack and a cross-sectional height of at least two electrodes between said sides, said package further comprises a thin metal foil encapsulating said stack with at least one axial seam and two end closures, one of said end closures including a generally flat end portion extending from said stack and terminating in a sealed section of said metal foil spaced outwardly from said stack, said flat end portion including a structure to open said package for access to said stack, said package further including an outer box having walls which form an internal cavity generally matching the shape of said package and an openable end for removal of said package in an axial direction, the package further including a pair of two layer wings extending axially along said foil and outwardly from the opposing sides of said foil, at least one of said wings engaging at least one of said walls and thereby forming a gap between said stack and said box, wherein said foil is a single sheet and only one of said wings define said seam.

2. A package as defined in claim 1 wherein said metal foil defines a cavity receiving said stack where said cavity has a vacuum to draw said encapsulating foil into contact with said stack whereby said foil is deformed by said electrodes.

3. A package as defined in claim 2 wherein said opening structure is a tear line in said end portion between said sealed section and said stack.

4. A package as defined in claim 1 wherein said opening structure is a tear line in said end portion between said sealed section and said stack.

5. A package as defined in claim 2 wherein said opening structure is a tear strip of removable foil in said end portion.

6. A package as defined in claim 1 wherein said opening structure is a tear strip of removable foil in said end portion.

7. A package as defined in claim 2 wherein said opening structure is a transversely movable closing element in said sealed section having a first position opening said sealed section and a second position closing and sealing said sealing section.

8. A package as defined in claim 1 wherein said opening structure is a transversely closing structure in said sealed section having a first position opening said sealed section and a second position closing and sealing said sealing section.

9. A package as defined in claim 8 wherein said seam includes an adhesive between two layers of said metal foil.

10. A package as defined in claim 7 wherein said seam includes an adhesive between two layers of said metal foil.

11. A package as defined in claim 6 wherein said seam includes an adhesive between two layers of said metal foil.

12. A package as defined in claim 5 wherein said seam includes an adhesive between two layers of said metal foil.

13. A package as defined in claim 4 wherein said seam includes an adhesive between two layers of said metal foil.

14. A package as defined in claim 3 wherein said seam includes an adhesive between two layers of said metal foil.

15. A package as defined in claim 2 wherein said seam includes an adhesive between two layers of said metal foil.

16. A package as defined in claim 1 wherein said seam includes an adhesive between two layers of said metal foil.

17. A package as defined in claim 8 wherein said foil includes a heat seal layer on one side and said seam includes a junction between said layer on two portions of said foil, which junction is heat sealed.

18. A package as defined in claim 7 wherein said foil includes a heat seal layer on one side and said seam includes a junction between said layer on two portions of said foil, which junction is heat sealed.

19. A package as defined in claim 6 wherein said foil includes a heat seal layer on one side and said seam includes a junction between said layer on two portions of said foil, which junction is heat sealed.

20. A package as defined in claim 5 wherein said foil includes a heat seal layer on one side and said seam includes a junction between said layer on two portions of said foil, which junction is heat sealed.

21. A package as defined in claim 4 wherein said foil includes a heat seal layer on one side and said seam includes a junction between said layer on two portions of said foil, which junction is heat sealed.

22. A package as defined in claim 3 wherein said foil includes a heat seal layer on one side and said seam includes a junction between said layer on two portions of said foil, which junction is heat sealed.

23. A package as defined in claim 2 wherein said foil includes a heat seal layer on one side and said seam includes a junction between said layer on two portions of said foil, which junction is heat sealed.

24. A package as defined in claim 1 wherein said foil includes a heat seal layer on one side and said seam includes a junction between said layer on two portions of said foil, which junction is heat sealed.

25. A package as defined in claim 8 wherein said metal foil has a printable layer on the exposed side of said foil.

26. A package as defined in claim 7 wherein said metal foil has a printable layer on the exposed side of said foil.

27. A package as defined in claim 6 wherein said metal foil has a printable layer on the exposed side of said foil.

28. A package as defined in claim 5 wherein said metal foil has a printable layer on the exposed side of said foil.

29. A package as defined in claim 4 wherein said metal foil has a printable layer on the exposed side of said foil.

30. A package as defined in claim 3 wherein said metal foil has a printable layer on the exposed side of said foil.

31. A package as defined in claim 2 wherein said metal foil has a printable layer on the exposed side of said foil.

32. A package as defined in claim 1 wherein said metal foil has a printable layer on the exposed side of said foil.

33. A package as defined in claim 1 wherein said seam is an overlapping seam lying flat along said one side of said stack.

34. A package as defined in claim 32 including a corrugated liner wrapped around said stack and between said foil and said stack.

35. A package as defined in claim 24 including a corrugated liner wrapped around said stack and between said foil and said stack.

36. A package as defined in claim 16 including a corrugated liner wrapped around said stack and between said foil and said stack.

37. A package as defined in claim 8 including a corrugated liner wrapped around said stack and between said foil and said stack.

38. A package as defined in claim 6 including a corrugated liner wrapped around said stack and between said foil and said stack.

39. A package as defined in claim 4 including a corrugated liner wrapped around said stack and between said foil and said stack.

40. A package as defined in claim 2 including a corrugated liner wrapped around said stack and between said foil and said stack.

41. A package as defined in claim 1 including a corrugated liner wrapped around said stack and between said foil and said stack.

42. A package as defined in claim 32 including at least one support band wrapped around said stack, said at least one band being a complete loop and positioned between said stack and said then metal foil encapsulating said stack.

43. A package as defined in claim 24 including at least one support band wrapped around said stack, said at least one band being a complete loop and positioned between said stack and said then metal foil encapsulating said stack.

44. A package as defined in claim 16 including at least one support band wrapped around said stack, said at least one band being a complete loop and positioned between said stack and said then metal foil encapsulating said stack.

45. A package as defined in claim 8 including at least one support band wrapped around said stack, said at least one band being a complete loop and positioned between said stack and said then metal foil encapsulating said stack.

46. A package as defined in claim 6 including at least one support band wrapped around said stack, said at least one band being a complete loop and positioned between said stack and said then metal foil encapsulating said stack.

47. A package as defined in claim 4 including at least one support band wrapped around said stack, said at least one band being a complete loop and positioned between said stack and said then metal foil encapsulating said stack.

48. A package as defined in claim 2 including at least one support band wrapped around said stack, said at least one band being a complete loop and positioned between said stack and said then metal foil encapsulating said stack.

49. A package as defined in claim 1 including at least one support band wrapped around said stack, said at least one band being a complete loop and positioned between said stack and said then metal foil encapsulating said stack.

50. A package as defined in claim 1 wherein said box is opaque and said stack has a flat face covered by said metal foil and said box has a flat side coterminous with said flat face with a limited vision opening exposing said flat face of said metal foil in said package.

51. A package as defined in claim 50 wherein said internal cavity has a given width and said metal foil has a lateral width comprising said stack and said pair of wings having a width, said lateral width being greater than said given width by an amount less than one of said pair of wings.

52. A package as defined in claim 1 wherein said internal cavity has a given width and said metal foil has a lateral width comprising said stack and said pair of wings having a width, said lateral width being greater than said given width by an amount less than one of said pair of wings.

53. A package as defined in claim 2 wherein said internal cavity generally matching the shape of more than one metal foil covered stack joined together.

54. A package as defined in claim 53 wherein said box is opaque and said stack of an exposed package has a flat face covered by said metal foil and said box has a flat face with a limited vision exposing said flat face of said foil in said package.

* * * * *